US009440780B2

(12) United States Patent
Su et al.

(10) Patent No.: US 9,440,780 B2
(45) Date of Patent: Sep. 13, 2016

(54) MICROWAVABLE FROZEN FOOD PACKAGE

(71) Applicant: Berry Plastics Corporation, Evansville, IN (US)

(72) Inventors: Jau-Ming Su, Kent, WA (US); Charisa Sofian, DKI Jakarta (ID); Paul Z Wolak, Indianapolis, IN (US)

(73) Assignee: Berry Plastics Corporation, Evansville, IN (US)

( * ) Notice: Subject to any disclaimer, the term of this patent is extended or adjusted under 35 U.S.C. 154(b) by 439 days.

(21) Appl. No.: 13/918,283

(22) Filed: Jun. 14, 2013

(65) Prior Publication Data

US 2013/0334217 A1 Dec. 19, 2013

Related U.S. Application Data

(60) Provisional application No. 61/659,553, filed on Jun. 14, 2012.

(51) Int. Cl.
*B65D 81/34* (2006.01)
*H05B 6/80* (2006.01)

(52) U.S. Cl.
CPC ..... *B65D 81/3461* (2013.01); *B65D 2205/02* (2013.01)

(58) Field of Classification Search
CPC ..... B65D 81/3461; B65D 2205/02
USPC ..... 219/727, 725, 728–731, 734, 735, 759; 426/107, 87, 110, 113, 114, 118, 123, 426/234, 241, 243; 99/DIG. 14; 53/412, 53/133.8, 141
See application file for complete search history.

(56) References Cited

U.S. PATENT DOCUMENTS

| | | | | |
|---|---|---|---|---|
| 5,630,308 | A | 5/1997 | Guckenberger | |
| 6,030,652 | A * | 2/2000 | Hanus | 426/107 |
| 6,644,491 | B2 | 11/2003 | Dewig et al. | |
| 7,303,088 | B2 | 12/2007 | Sawyer et al. | |
| 7,919,738 | B2 * | 4/2011 | Su et al. | 219/730 |
| 2003/0051440 | A1 * | 3/2003 | Chow | B29C 59/007 53/412 |
| 2007/0187407 | A1 | 8/2007 | Driskill et al. | |
| 2009/0045189 | A1 * | 2/2009 | Cormier et al. | 219/727 |

* cited by examiner

*Primary Examiner* — Quang Van
(74) *Attorney, Agent, or Firm* — Barnes & Thornburg LLP

(57) ABSTRACT

A container includes a sleeve, a first end closure, and a second end closure. The first end closure closes off a first end of the sleeve and the second end closes off an opposite second end of the sleeve. The sleeve and end closures cooperate to define an interior region therebetween that receives products therein.

36 Claims, 4 Drawing Sheets

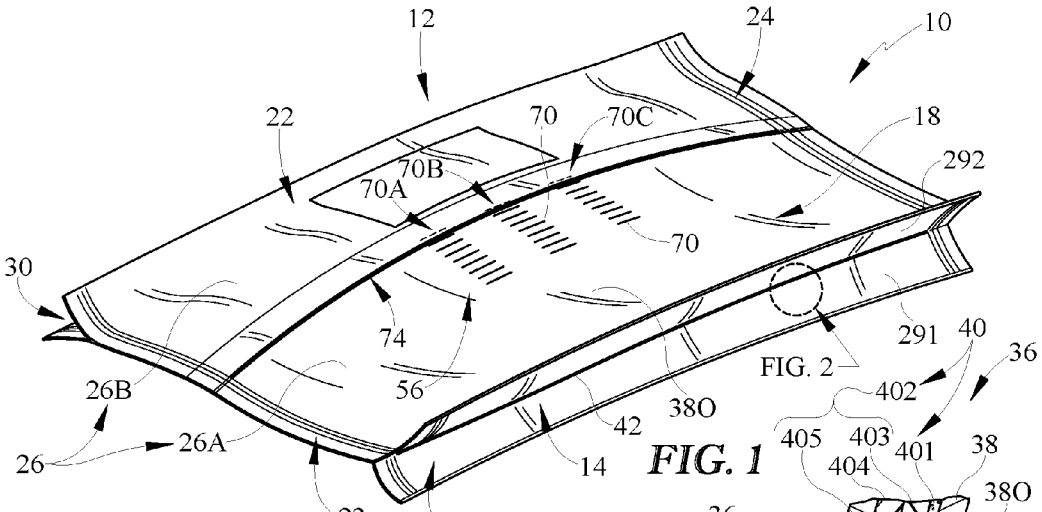
FIG. 1
FIG. 2
FIG. 3
FIG. 4
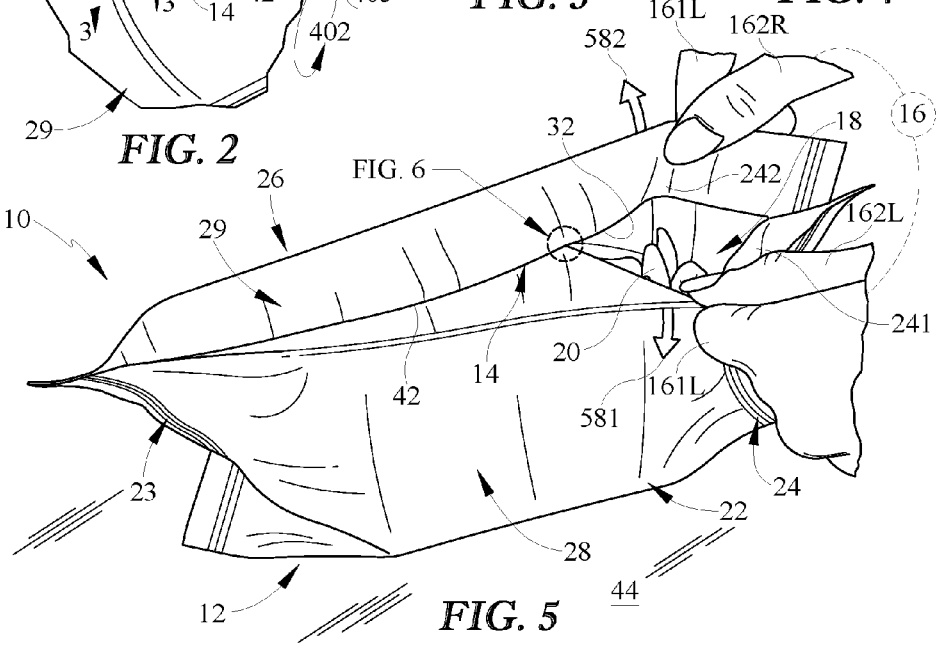
FIG. 5

MICROWAVABLE FROZEN FOOD PACKAGE

PRIORITY CLAIM

This application claims priority under 35 U.S.C. §119(e) to U.S. Provisional Application Ser. No. 61/659,553, filed Jun. 14, 2012, which is expressly incorporated by reference herein.

BACKGROUND

The present disclosure relates to a package, and in particular to a package subjected to freezing temperatures during storage or transportation. More particularly, the present disclosure relates to a package subjected to both freezing temperatures and heating temperatures.

SUMMARY

A container in accordance with the present disclosure includes a sleeve, a first end closure, and a second end closure. The first end closure closes off a first end of the sleeve and the second end closes off an opposite second end of the sleeve. The sleeve and end closures cooperate to define an interior region therebetween that receives products therein.

In illustrative embodiments, a package includes a container and an opening system formed in the container. The opening system is configured to provide means for establishing a mouth that opens into the interior region to cause the products stored in the interior region to be accessible by a user in response to application of separation forces applied to the container at predetermined locations after heating of the package has completed without causing a passageway to be formed in the container before heating or during heating so that steam and pressure are generated in a controlled manner during heating of the package.

In illustrative embodiments, the container is formed from a cold-durable, heat-resistant film. The cold-durable, heat-resistant film includes an outer protective layer and an inner sealant layer laminated to the outer protective layer. The outer protective layer provides cold-temperature durability while the inner sealant layer provides hot-temperature durability. The opening system is formed in the outer protective layer to cause the mouth to open predictably in the container when separation forces are applied to the container.

In illustrative embodiments, the opening system includes a trench formed in the outer protective layer of the cold-durable, heat-resistant film. The trench is arranged to extend between the first and second end closures and extend downwardly from an outer surface of the outer protective layer to an inner surface of the outer protective layer that faces the inner sealant layer.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIGS. 1-6 provide a series of views showing a freezable, microwavable package in accordance with a first embodiment of the present disclosure including a double-gusset container and an opening system formed in the double-gusset container to allow the package to be heated without causing an opening to form in the double-gusset container until after heating of the package has been completed and a user applies separation forces (double arrows) to the opening system to cause a mouth to be formed in the double-gusset container that opens into an interior region so that product may be removed;

FIG. 1 is a perspective view of the package prior to heating showing the opening system formed along a first side wall and suggesting that application forces are applied to the side wall to cause the mouth to be formed as suggested in FIGS. 5 and 6;

FIG. 2 is an enlarged partial perspective view of a portion of FIG. 1 showing that the opening system is formed along a crease formed in the side wall;

FIG. 3 is a sectional view taken along line 3-3 of FIG. 2 showing that the opening system includes a trench extending downwardly into an outer protective layer included in a cold-durable, heat-resistant film used to form the double-gusset container and that the trench terminates at a trench floor defined by an inner protective layer included in the cold-durable, heat-resistant film;

FIG. 4 is a sectional view taken along line 4-4 of FIG. 2 showing the trench included in the opening system is configured to have a width and a depth that permits fracturing along the trench as suggested in FIGS. 5 and 6;

Figure 6:
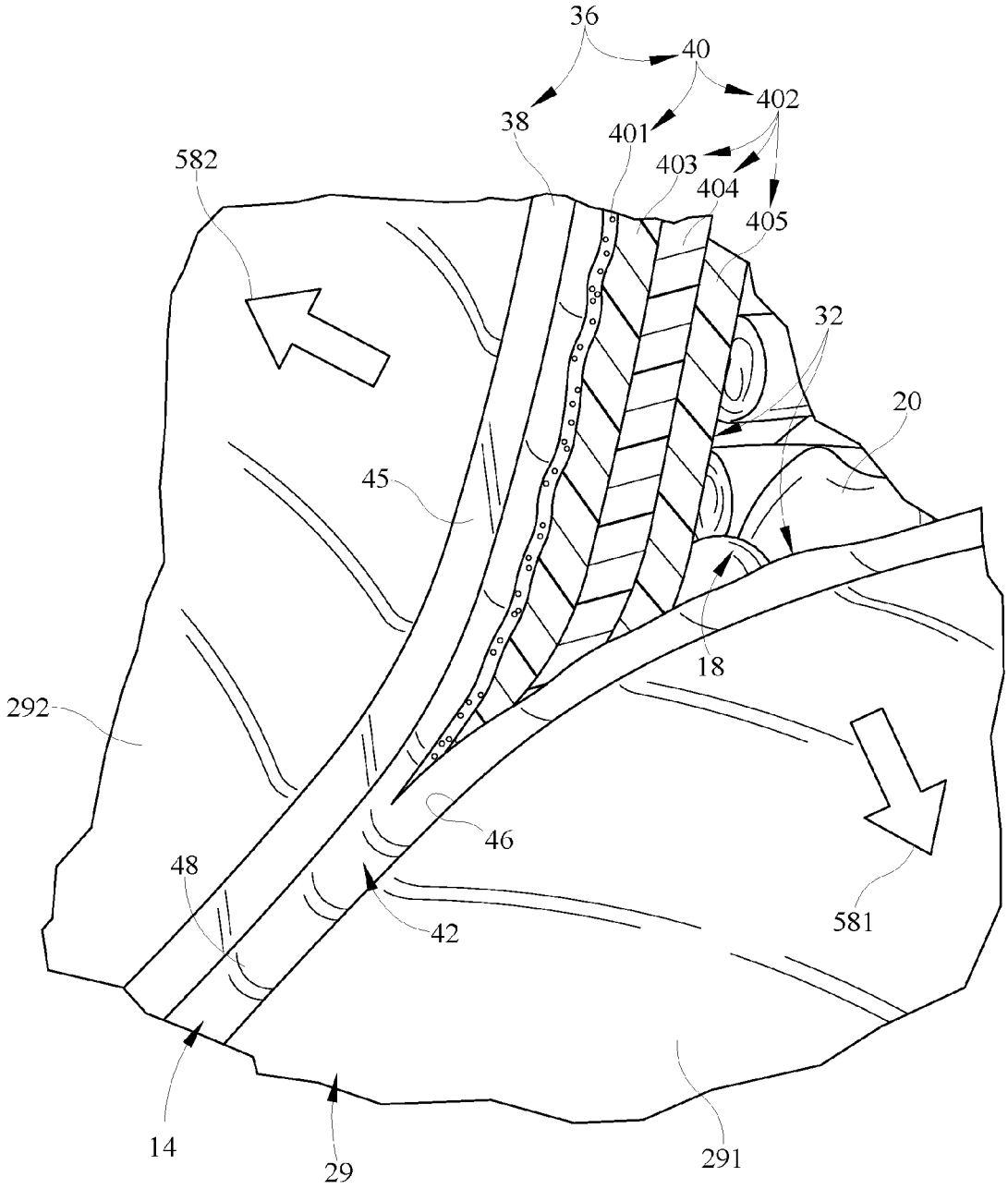
Figure 7:
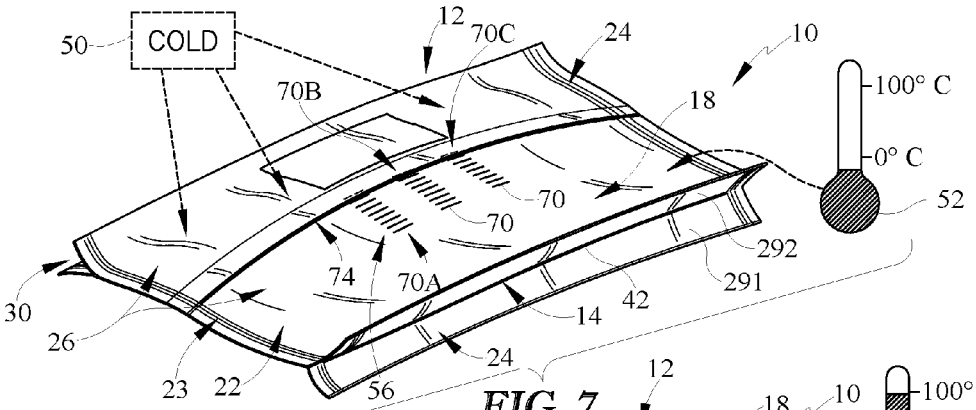
Figure 8:
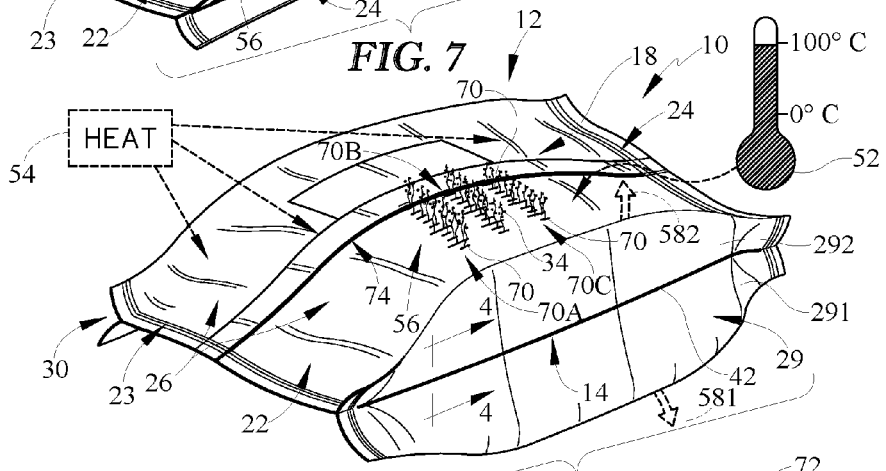
Figure 9:
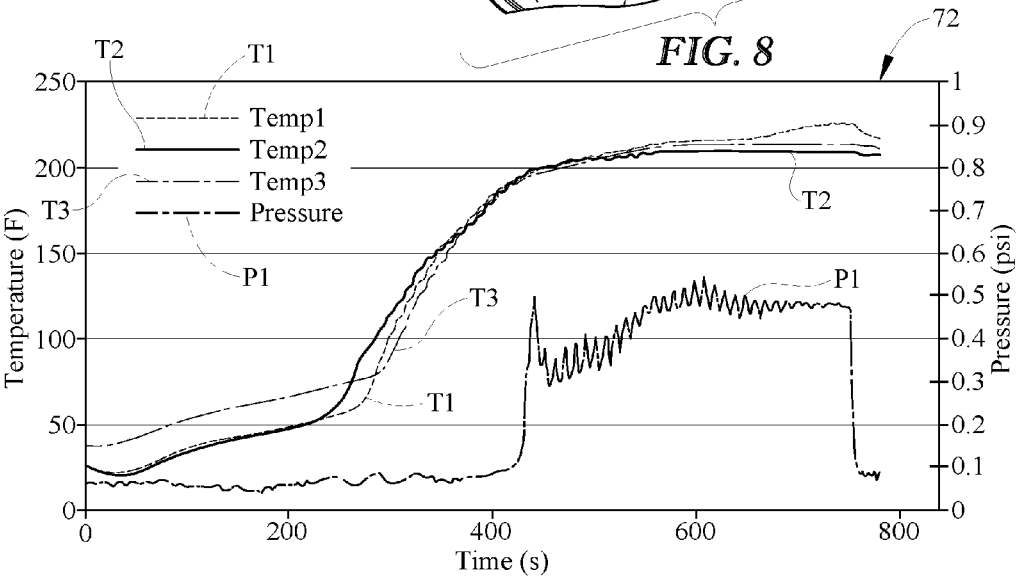
Figure 10:
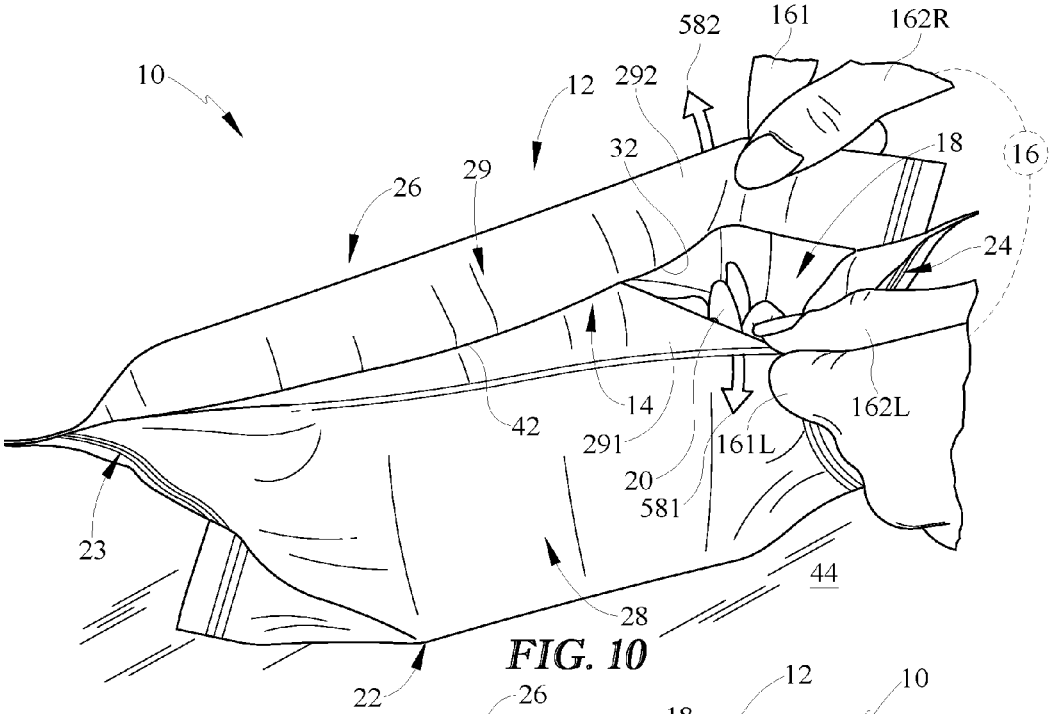
Figure 11:
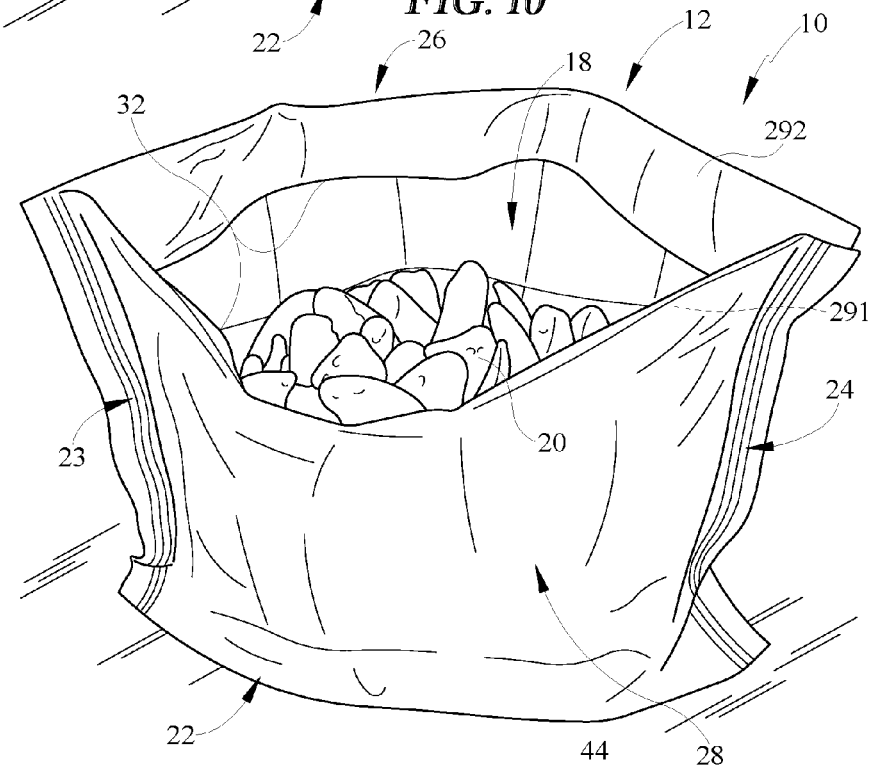

FIG. 5 is a perspective view of the container of FIG. 1 showing a user grasping a right-side portion of the side wall with a right hand and grasping a left-side portion of the side wall with a left hand and applying separation forces (double arrows) to the side wall to cause the double-gusset container to fracture along the trench in a controlled manner to cause the mouth to be formed as suggested in FIG. 11;

FIG. 6 is an enlarged partial perspective view of a portion of FIG. 5 showing the opening system during application of the separation forces that causes the inner protective layer to fracture along the trench in a controlled manner so that the mouth is established as suggested in FIG. 11;

FIGS. 7-11 provide a series of views showing the package of FIGS. 1 and 5 undergoing freezing, heating, and opening of the package so that products in the interior region are exposed after heating of the package has completed;

FIG. 7 is a perspective view of the package undergoing freezing showing the package being subjected to below freezing temperatures as indicated by a thermometer bar to the right of the package that shows a below-freezing temperature of air in the interior region of the double-gusset container;

FIG. 8 is a view similar to FIG. 7 showing the package being exposed to heat which that causes the temperature in the interior region to increase as shown by the thermometer bar to the right of the package, causes steam to be formed in the interior region that causes the double-gusset container to bulge upwardly, and causes steam to escape in a controlled manner through a steam-venting system formed in the double-gusset container without causing the opening system to open prematurely during heating;

FIG. 9 is a graph showing how pressure and temperature change during heating of the package of FIGS. 7 and 8;

FIG. 10 is a perspective view similar to FIG. 5 showing the user applying separation forces to the side wall to cause the container to fracture along the trench to form the mouth suggested in FIG. 11; and FIG. 11 is a view similar to FIG. 10 showing the mouth formed in the double-gusset container to allow access to the interior region and showing that after the side wall is fractured along the trench, inner flaps are formed that may be folded downwardly into interior region.

DETAILED DESCRIPTION

A package 10 includes a double-gusset container 12 and an opening system 14 as shown, for example, in FIGS. 1-8. Opening system 14 is formed in double-gusset container 12 to allow package 10 to be heated without causing an opening to form in double-gusset container 12 until after heating of package 10 has been completed and a user 16 applies separation forces (double arrows) 16F to opening system 14 as suggested in FIGS. 7, 8, 10, and 11. As a result of applying separation forces 16F to opening system 14, a mouth 32 is formed in double-gusset container 12 that opens into an interior region 18 formed in double-gusset container 12 so that product 20 may be accessed.

Double-gusset container 12 includes a sleeve 22, a first end closure 23 and a second end closure 24 as shown in FIGS. 1 and 5. First end closure 23 closes off a first end of sleeve 22 and second end closure 24 closes off an opposite second end of sleeve 22 so that interior region 18 is formed therein. Opening system 14 illustratively is formed in sleeve 22 to extend between end closures 23, 24 as shown in FIGS. 1 and 3.

Sleeve 22 includes, for example, a top wall 26, an opposite bottom wall 28, a first side wall 29, and a second side wall 30 as shown in FIGS. 1 and 3. Top wall 26 is spaced apart from bottom wall 28. First side wall 29 interconnects top and bottom walls 26, 28. Second side wall 30 is spaced apart from first side wall 29 and interconnects top and bottom walls 26, 28 as shown in FIG. 1. First end closure 23 interconnects and couples first and second side walls 29, 30 to top and bottom walls 26, 28 along the first end of sleeve 22. Second end closure 24 interconnects and couples first and second side walls 29, 20 to top and bottom walls 26, 28 along the second end of sleeve 22.

Opening system 14 is configured to provide means for providing mouth 32 that opens into interior region 18 to cause products 20 stored in interior region 18 to be accessible by user 16 in response to application of separation forces 16F to top and bottom walls 26, 28 along first side wall 29 after heating of package 10 has completed without causing a passageway to be formed in double-gusset container 12 before or during heating so that steam 34 and pressure are generated in a controlled manner during heating as shown in FIGS. 7-11. In an illustrative example, opening system 14 is formed in first side wall 29 as shown in FIGS. 1, 5, 7, 8, 10, and 11.

Sleeve 22 is made using a cold-durable, heat-resistant film 36 that includes an outer protective layer 38 and an inner layer 40 as shown, for example in FIGS. 3, 4, and 6. Opening system 14 is a trench 42 formed in outer protective layer 38 as shown in FIGS. 3, 4, and 6. Outer protective layer 38 is configured to be cold durable which means that outer protective layer 38 resists fracturing when subjected to cold temperatures as suggested in FIG. 7. Inner layer 40 is configured to be heat resistant which means that inner layer 40 resists melting when subjected to heat as suggested in FIG. 8. During application of separation forces 16F, inner layer 40 fractures in a predetermined manner along trench 42 as shown in FIG. 6.

Cold-durable, heat-resistant film 36 is formed by laminating outer protective layer 38 to inner layer 40. Outer protective layer 38 includes an outer surface 380 which is arranged to face away from inner layer 40 and an inner surface 381 arranged to face opposite outer surface 380 towards inner layer 40. Inner layer 40 includes an outer surface 400 arranged to face toward outer protective layer 38 and an inner surface 401 arranged to face opposite outer surface 400 toward interior region 18. During manufacturing of package 10, trench 42 is formed in outer protective layer 38 and arranged to extend downwardly from outer surface 380 of outer protective layer 38 to inner surface 381 of outer protective layer 38 to cause outer surface 400 of inner layer 40 to be exposed.

As shown in FIG. 6, trench 42 includes a first trench side wall 45, a second trench sidewall 46, and a trench floor 48. First trench side wall 45 is arranged to extend between and interconnect outer and inner surfaces 380, 381 of outer protective layer 38. Second trench side wall 46 is spaced apart from first trench side wall 45 and is arranged to extend between and interconnect outer and inner surfaces 380, 381 of outer protective layer 38. Trench floor 48 is provided by outer surface 400 of inner layer 40 and is arranged to extend between first and second trench side walls 45, 46 as shown in FIGS. 3, 4, and 6. In an example, trench 42 is formed by a laser removing material from outer protective layer 38 so that trench 42 is established. However, any other suitable means for forming trench 42 may be used.

In an example of use, package 10 is filled with products 20 at the site of manufacture. In one example, products 20 are food products. As a result, package 10 is subjected to cold 50 so that below freezing temperatures are developed in interior region 18 as measured by a thermometer bar 52 as shown in FIG. 7. Freezing package 10 may be useful for storage and transportation of food products. Next, package 10 may be subjected to heat 54 so that heating temperatures are developed in interior region 18 as measured by thermometer bar 52 as shown in FIG. 7. As a result of developing heating temperatures, pressure and steam are generated in interior region 18 to heat and cook food products 20. Package 10 is then left to cool after heating so that a user may open package 10 as shown in FIGS. 1, 5, 6, 10, and 11.

After package 10 has cooled, user 16 reorients package 10 from a flat position shown in FIGS. 1, 7, and 8 to an upright position shown in FIGS. 5, 10, and 11 to open 10 using opening system 14. When package 10 is in the flat position, top and bottom walls 26, 28 are substantially horizontal relative to ground 44 so that a steam-venting system 56 formed in container 12 is arranged to face upwardly away from ground 44. When package 10 is in the upright position, top and bottom walls 26, 28 are substantially vertical relative to ground 44 underlying package 10 so that mouth 32 when formed opens in the upward direction and food products 20 remain in interior region 18 until removed by the user.

Once package 10 is in the upright position, user 16 grasps a portion of first side wall 29 and top wall 26 with a right forefinger 161R and a right thumb 162R and a portion of first side wall 29 and bottom wall 28 with a left forefinger 161L and a left thumb 162L as shown in FIGS. 5 and 10. User 16 is then able to apply a first separation force 581 to first side wall 29 and top wall 26 and a second separation force 582 to first side wall 29 and bottom wall 28. First separation force 581 is applied in a direction opposite to second separation force 582. As an example, separation forces 581, 582 are arranged to be perpendicular to trench 42 so that opening system 14 forms along trench 42 and mouth 32 is established along trench 42 as shown in FIG. 10.

As user 16 applies separation forces 581, 582 to package 10, inner layer 40 fractures along trench 42 as a result of outer protective layer 38 being removed to weaken container 12 along trench 42. Once mouth 32 is established, first side wall 29 is divided into a first wing 291 and a second wing 292 as shown in FIGS. 10 and 11. First and second wings 291, 292 are allowed to fall into or are folded downwardly into interior region 18 so that a clean, dry mouth 32 is provided as shown in FIG. 11.

At the same time package 10 is arranged in the upright position, second side wall 30 is arranged to lie substantially flat in confronting relation with ground 44. As a result, second side wall 30 includes a first foot 301 and a second foot 302. First and second feet 301, 302 are arranged to provide support to container 12 that minimizes tipping of container 12 when in the upright position. After mouth 32 and feet 301, 302 are provided for, container 12 has a bowl-like shape that may be used to serve food products 20 directly therefrom. As a result, package 10 may be used for freezer storage, heating, and serving causing mess and waste to be minimized.

As discussed above, container 12 is formed from cold-durable, heat-resistant film 36. As shown in FIGS. 3 and 4, cold-durable, heat-resistant film 36 includes outer protective layer 38 and inner layer 40. Inner layer 40 includes an adhesive layer 401 and a sealant layer 402. Adhesive layer 401 is positioned to lie between sealant layer 402 and outer protective layer 38. Sealant layer 402 includes, from inside out, an outer skin sub-layer 403, a core sub-layer 404, and a heat-sealable sub layer 405 as shown in FIGS. 3 and 4. As used in the present disclosure, sub-layer means a layer included in a composition comprising several layers, for example, sealant layer 402, and is not meant to indicate position with respect to any other layer.

In use, outer skin sub-layer 403 is configured to resist heat and steam generated during heating and maintain form when exposed to such hot temperatures as suggested in FIG. 8. Heat sealable sub-layer 405 is configured to resist freezing temperatures, maintain durability when exposed to such freezing temperatures as suggested in FIG. 7, and have a relatively low seal initiation temperature. Core sub-layer 404 is configured to lie between and interconnect outer skin sub-layer 403 and heat sealable sub-layer 405 as shown in FIGS. 3 and 4 and resist heat and steam generated during heating and maintain form when exposed to such hot temperatures as suggested in FIG. 8.

As illustrated in FIGS. 3 and 4, cold-durable, heat-resistant film 36 is used to establish a container in accordance with the present disclosure that includes a multilayer polyolefin sealant layer 402 having at least three sub-layers: (a) heat sealable sub-layer 405; (b) a core sub-layer 404 adjacent to heat sealable sub-layer 405; and (c) an outer skin sub-layer 403 adjacent to core sub-layer 404 such that core sub-layer 404 is sandwiched between heat sealable sub-layer 405 and outer skin sub-layer 403. In illustrative embodiments, adhesive layer 401 laminates outer skin sub-layer 403 of the multilayer polyolefin sealant layer 402 to outer protective layer 38 to form cold-durable, heat-resistant film 36 that has a thickness of about 1 mil to about 10 mil.

Heat sealable sub-layer 405 of the multilayer polyolefin sealant layer 402 is formed from at least one thermoplastic polymer that is capable of heat sealing to itself or to another film layer. In order to make a film suitable for use as packaging for both freezer storage and heating, inner heat sealable sub-layer 405 of multilayer film 36 should meet the following requirements: (1) it should have a low heat seal initiation temperature in order to be able to form adequate heat seals on standard packaging machines or form-fill-seal machines (either vertical or horizontal); (2) it should maintain its strength, i.e., not fracture, and have good ductility in subzero freezer temperatures (about −20° C. to about 0° C.); (3) it should be able to maintain sufficient heat seal or control at microwave temperatures (about 71° C. to about 105° C.) without losing control of steam pressure generation, bursting or leaking; and (4) it should peel easily fracture after microwave cooking with separation forces 581, 582 of about 250 lbf/in to about 500 lbf/in.

Suitable materials for forming heat sealable sub-layer 405 of multilayer polyolefin sealant layers 402 of the present disclosure include, but are not limited to, those that have a seal initiation temperature within the range of from about 105° C. to about 135° C., and melting points within the range of from about 105° C. to about 150° C. As an example, heat sealable sub-layer 405 is formed from at least one propylene/alpha-olefin copolymer. Suitable propylene/alpha-olefin copolymers include propylene/ethylene copolymer, propylene/butene copolymer, propylene/hexene copolymer, propylene/octene copolymer, mixtures thereof, blends thereof, and the like.

As another example, heat sealable sub-layer 405 is formed from at least one propylene/ethylene copolymer (which may be in a random propylene/alpha-olefin copolymer) and at least one polyethylene resin. The polyethylene resin having a melt index of about 0.50 g/10 min. (measured at 190° C. in accordance with ASTM D1238-04) to about 20 g/10 min. (measured at 190° C. in accordance with ASTM D1238-04).

In yet another example, heat sealable sub-layer 405 is formed from at least one propylene/ethylene copolymer (which may be in a random propylene/alpha-olefin copolymer) and two different polyethylene resins one of which has a melt index of about 0.50 g/10 min. (measured at 190° C. in accordance with ASTM D1238-04) to about 20 g/10 min. (measured at 190° C. in accordance with ASTM D1238-04). Suitable polyethylene resins for use herein are, for example, ethylene/octene copolymer (a polyethylene resin derivative also known as a polyolefin elastomer), linear low density polyethylene (LLDPE), low density polyethylene (LDPE), high density polyethylene (HDPE), and polyethylene resin derivatives such as ethylene vinyl acetate, ethylene methyl acrylate, and the like. Suitable propylene/ethylene copolymers for use herein are, for example, polypropylene copolymers comprising from about 1% to about 8% by weight of ethylene comonomer and having a melt flow rate from about 0.5 g/10 min. (measured at 230° C. in accordance with ASTM D1238-04) to about 45 g/10 min. (measured at 230° C. in accordance with ASTM D1238-04).

Without wishing to be bound by theory, it is believed that blending propylene/alpha-olefin copolymer resins (e.g., propylene/ethylene copolymer) with one or more polyethylene resins in heat sealable sub-layer 405 leads to cold-durable, heat-resistant film 36. The incorporation of ethylene comonomer in the propylene/ethylene copolymer may increase irregularity of the polymer chains which may reduce the crystallinity of the polymer. This may result in a lower seal initiation temperature than if homopolymer polypropylene were used as the heat sealable material, as well as improved ductility at subzero temperatures.

When a frozen, microwavable packaged food product is cooked in a microwave oven, the steam generated from the food has a temperature close to the boiling point of water, i.e., about 100° C. Under typical microwave cooking conditions, as long as the steam exists in the package, the maximum steam temperature in the package typically remains below 104° C. Polypropylene resins such as Dow H110-02 (melting temperature 161° C.), Dow 6D20 (melting temperature 148° C.), Dow 3000 (melting temperature 108° C.), and Total EOD02 (now Total LX502-15, melting temperature 119° C.), as well as polyethylene terephthalate (PET, melting temperature 230-260° C.) film or polypropylene homopolymer (PP) in an outer protective sub-layer (melting temperature 158-165° C.), each have a melting temperature above 104° C. As such, they can withstand the heat generated during microwave cooking.

Again, without wishing to be bound by theory, steam generated during the course of a microwave cooking cycle is believed to serve the dual purpose of heating a food product and cooling so-called hot spots that may develop in the microwavable package. As stated above, the maximum steam temperature within the package typically remains below 104° C. However, the actual temperature of a food product, in particular those including foods containing, for example, oil(s), sauce(s), sugar(s), starch(es), and the like, may exceed 120° C. (resulting in film scorching and/or film burn-through) if the moisture content of the food product is insufficient to support steam generation that would otherwise provide the aforementioned cooling effect. Thus, the aforementioned exemplary food products are also compatible with the present technology, provided that they maintain a moisture content sufficient for steam generation throughout the microwave cooking cycle.

Dow 8150, Dow 5400G, and Huntsman LD1058 each have a low glass transition temperature (−52° C., <−80° C., and <−80° C., respectively) and thus provide durability in a freezer at subzero temperatures. Dow 5400G and Hunstman LD1058 are polyethylene resins, whereas Dow 8150 is an ethylene-based polyolefin elastomer (i.e., ethylene/octene copolymer). Because of their ethylenic nature, all three of the aforementioned resins have a certain degree of incompatibility with polypropylene resins.

It has been surprisingly found that, under certain heat sealing conditions and/or temperature ranges, the aforementioned incompatibility can be exploited to prepare sealant films that, while maintaining their strength and ductility in subzero freezer temperatures and sufficient heat seal at microwave temperatures, cannot achieve a complete fusion seal with trays or films made from polypropylene resins.

Again, without wishing to be bound by theory, because polypropylene is the major component in heat sealable sub-layer 405, an extrusion (e.g., melt mixing) process is believed, based on microscopic examination, to create a cold-durable, heat-resistant film 36 with polyethylene particles dispersed in the continuous phase of a polypropylene matrix. Due to the aforementioned incompatibility, weak Van der Waals forces rather than strong covalent bonding occur between polyethylene particles and the polypropylene matrix in such a film. Upon stretching such a film, separation of polyethylene particles from the polypropylene matrix occurs resulting in many voids (i.e., gaps or holes) in the peelable film being visible under microscopic examination. Thus, after heat sealing, polyethylene particles bonded to the brim of a polypropylene container by similarly weak forces would be separated easily from the polypropylene, thereby enhancing peelability.

Surprisingly, in spite of a tendency for polyethylene particles to separate from a polypropylene matrix, blending in additional polyethylene resin(s) apparently enhances the adhesive and elastic properties of both the polypropylene and polyethylene phases. As a result, in a hot environment, e.g., at temperatures used in conventional residential microwave ovens (about 71° C. to about 105° C.), a sufficient heat seal may be maintained with a cold-durable, heat-resistant film 36 without bursting or leaking and without losing control of steam pressure generation.

In a cold environment, when an external impact force is applied to a cold-durable, heat-resistant film 36, undesired processes such as plastic deformation, dislocation gliding, polymer crystal twining, and/or polymer chain extension would normally be expected to occur in the polypropylene matrix. Such processes would be expected to result in the formation of cracks, microvoids, and/or creases around the polyethylene particles. Surprisingly, however, polyethylene particles apparently act as energy sinks or crack stoppers to absorb impact energy and inhibit formation and/or propagation of cracks, microvoids and/or creases. Microvoiding and creasing, as well as cracking, are a consequence of the local stress state around polyethylene particles, and are dependent on the adhesion between the polypropylene matrix and polyethylene particles and the elastic properties of both phases. Blending polypropylene resin(s) with one or more polyethylene resin(s) apparently enhances the adhesive and elastic properties of both the polypropylene and polyethylene phases to create a cold-durable, heat-resistant film 36 that maintains its strength, i.e., does not fracture, and has good ductility in subzero freezer temperatures (about −20° C. to about 0° C.).

The thickness of heat sealable sub-layer 405 depends, in part, upon the size of the food package to be made from cold-durable, heat-resistant film 36 of the present technology. The inner heat sealable sub-layer must be thick enough to form a strong seal that will not fail when exposed to temperatures in a range from about 71° C. to about 105° C., yet not so thick that it negatively affects the manufacture of the sealant layer. In general, the thickness of the heat sealable sub-layer may be in a range from about 0.1 mil to about 3 mils.

Core sub-layer 404 is adjacent to heat sealable sub-layer 405. Core sub-layers suitable for use with the present technology are formed from thermoplastic materials that are compatible with the materials selected for the inner heat sealable sub-layer, and that can form a strong adhesive bond with the heat sealable sub-layer in order to prevent delamination of the sub-layers from occurring during freezer storage and microwave cooking. The core sub-layer should also have a melting point well above microwave cooking temperatures (from about 71° C. to about 105° C.) in order to maintain its solid state and strength when the inner heat sealable sub-layer starts to soften in the microwave.

Examples of materials suitable for use in forming the core sub-layer 404 of the multilayer polyolefin sealant layer 402 of the present disclosure include, but are not limited to, polypropylenes or polyethylene resins, blends thereof or mixtures thereof. For example, one example of a material for the core sub-layer is a homopolymer polypropylene having a melt flow rate of about 0.5 g/10 min. (measured at 230° C. in accordance with ASTM D1238-04) to about 25 g/10 min. (measured at 230° C. in accordance with ASTM D1238-04), and a melting point of about 155° C. to about 165° C. Another example of a material for the core sub-layer is an ethylene/octene copolymer (a polyethylene resin derivative also known as a polyolefin elastomer) having a melt index of about 0.5 g/10 min (measured at 190° C. in accordance with ASTM D1238-04 to about 20 g/10 min. (measured at 190° C. in accordance with ASTM D1238-04). An example of a blend or mixture includes homopolymer polypropylene and ethylene/octene copolymer. In general, the thickness of the core sub-layer may range from about 0.1 mil to about 4 mils.

Outer skin sub-layer 403 is adjacent to the core sub-layer 404. Outer skin sub-layers suitable for use with the present technology are formed from at least one thermoplastic material, and are formed form a blend of thermoplastic materials. Examples of materials suitable for use in forming the outer skin sub-layer 403 of the multilayer polyolefin sealant layer 402 of the present disclosure include, but are not limited to, polypropylene or polyethylene resins, blends thereof or mixtures thereof. For example, one material for the outer skin sub-layer is a homopolymer polypropylene having a melt flow rate of about 0.5 g/10 min. (measured at 230° C. in accordance with ASTM D1238-04) to about 25 g/10 min. (measured at 230° C. in accordance with ASTM D1238-04), and a melting point of about 155° C. to about 165° C. Another material for the outer skin sub-layer is an ethylene/octene copolymer (a polyethylene resin derivative also known as a polyolefin elastomer) having a melt index of about 0.5 g/10 min (measured at 190° C. in accordance with ASTM D1238-04 to about 20 g/10 min. (measured at 190° C. in accordance with ASTM D1238-04). An example of a blend or mixture includes homopolymer polypropylene and ethylene/octene copolymer. In general, the thickness of the outer skin sub-layer may range from about 0.1 mil to about 4 mils.

Multilayer polyolefin sealant layers of the present technology may be manufactured using a variety of known film processing techniques (e.g., coextrusion, lamination, and the like). For example, a multilayer polyolefin sealant layer of the present technology can be made via a blown film coextrusion process. In such an embodiment, the multilayer sealant layer is formed using a blown film apparatus composed of a multi-manifold circular die head having concentric circular orifices. The multilayer sealant layer is formed by coextruding a molten layer through a circular die, and a molten layer on the other or each opposite side of the first layer through additional circular dies concentric with the first circular die. Next, a gas, typically air, is blown through a jet that is concentric with the circular dies, thereby forming a bubble that expands the individual layers. The bubble is collapsed onto itself to form a pair of multilayer films attached at two opposite edges. Usually, the pair of attached multilayer films are then cut apart at one or more edges and separated into a pair of multilayer films that can be rolled up.

Alternatively, multilayer polyolefin sealant layers of the present technology can be manufactured using other extrusion processes, such as a cast film process, wherein melted and plasticized streams of individual layer materials are fed into a coextrusion die, such as a multi-manifold die. Upon emersion from the die, the layers are quenched to form a single multilayer film of polymeric material. Multilayer polyolefin sealant films of the present technology can also be manufactured by a lamination process, in which each layer of the film is formed separately, and the layers are then laminated together to arrive at the polyolefin film.

Package 10 illustratively further includes a steam-venting system 56 that is formed in container 12 as shown in FIGS. 1, 7, and 8. As an example, steam-venting system 56 is a steam-venting system 56 that is configured to provide means for controlling pressure P and temperature T in interior region 18 during heating of package 10 to cause steam to be generated in interior region 18 and conducted through container 12 so that food products 20 stored in interior region 18 are heated uniformly throughout and opening system 14 remains closed throughout heating of package 10 as suggested in FIG. 8.

Steam-venting system 56 includes a series of spaced-apart apertures or slits 70 as shown in FIGS. 1, 7, and 8. As an example, there are three columns 70A, 70B, 70C of slits 70 formed in top wall 26. Each column 70A, 70B, 70C of slits 70 includes slits having various lengths and spaced apart from one another. In another embodiment, all of slits 70 may have a similar length. Each slit may be formed to extend through outer protective layer 38 and inner layer 40 so that a continuous passageway is always open between interior region 18 and environment surrounding package 10.

During an initial stage of heating, heat 54 is applied to package 10 causing the temperature in interior region 18 to increase as measured by thermometer bar 52 as shown in FIG. 8. Heating causes steam 34 to be created as temperature and pressure in interior region 18 increases as shown in FIG. 8. Steam 34 presses on heat sealable sub-layer 405 and moves through continuous passageways formed by slits 70. As heating continues, steam 34 continues to build in interior region 18 while also venting at an increased rate through slits 70 into atmosphere surrounding package 10 as shown in FIG. 8. As a result, pressure and temperature in interior region 18 are controlled so that food products 20 are heated uniformly throughout without causing opening system 14 to open prematurely.

As an example of steam-venting system 56 in use, a graph 72 showing heating of package 10 including steam-venting system 56 is shown in FIG. 9. Graph 72 shows how a first temperature T1, a second temperature T2, a third Temperature T3, and a pressure P1 in interior region 18 of container 12 changes during heating. As can be seen in FIG. 9, steam-venting system 56 allows temperatures and pressures in interior region 18 to increase until steam 34 is generated and conducted through slits 70 formed in container 12. Once steam 34 begins to move through slits 70, pressure is controlled so that temperatures remain generally stable as heating continues. As a result, steam-venting system block unintended opening of opening system 14 during heating.

In another embodiment, each slit may also be me formed to only extend partially through outer and inner layers 36, 38. During heating, steam and pressure may be generated until sufficient pressure is available to cause to cause film 36 to rupture at each slit and form a passageway. As a result, interior region is sealed from atmosphere until sufficient and pressure is generated during heating to rupture each slit.

Sleeve 22 further includes, for example, a fin closure 74 extending between first and second end closures 23, 24 as shown in FIGS. 1, 5, 7 and 8. Fin seal 74 is positioned to lie about midway between first and second side walls 29, 30 on top wall 26. Fin closure 74 is established as a result of forming cold-durable, heat-resistant film 36 into sleeve 22. Film 36 includes a first edge and an opposite second edge that come together during filling of sleeve 22 with product and are joined together to form fin closure 74.

Fin closure 74 divides top wall 26 into a first panel 26A and a second panel 26B. First panel 26A is coupled to first side wall 29 and is arranged to extend toward second side wall to locate fin closure between first side wall 29 and second side wall 30. Second panel 26B is coupled to second side wall 30 and is arranged to extend toward fin closure 74. After fin closure 74 is established, fin closure 74 is arranged to lie over first panel 26A and extend toward first side wall 29. As an example, steam-venting system 56 is formed in first panel 26A as shown in FIGS. 1, 7, and 8.

Freezable, microwavable package 10 includes opening system 14. In one example, opening system 14 is an easy-open laser scoring feature that can be torn easily before or after package 10 is cooked or heated in a microwave. After heating, opening system 14 allows package 10 to be used as food bowl or container that is configured to contain food products with liquids, sauces, or seasonings.

Package 10 of the present disclosure further includes a venting system that controls steam pressure in package 10 during microwave cooking or heating. As a result, bursting of package 10 is blocked so that food products are cooked generally uniform throughout. In one example, the venting system is a mechanical venting system that includes slits which allows communication between the interior region of the container and atmosphere at all times. In another example, the venting system is a laser venting system that blocks communication between the interior region and atmosphere until sufficient pressure is developed to cause the laser venting system to open and allow steam to be communicated to atmosphere.

The package may be made from a laminated multilayer film that can withstand subzero temperatures required for frozen foods and high temperatures required in microwave cooking or heating. In addition, the easy-open laser scoring on the package can be easily torn at cold temperatures (before cooking) and hot temperatures (after cooking).

As shown in FIGS. 1-3, opening system 14 is a continuous trench extending between end closures 23, 24. In another example, opening system 14 includes a weakening pattern or line that extends into, but not completely through the cold-durable, heat-resistant film. In addition the easy-open laser score does not affect cooking performance as formation of mouth 32 is blocked until separation forces are applied to the container.

In one illustrative example, opening system 14 was formed using a CO2 laser. The laser did not completely cut through the film, but instead left a trench having a depth in a range of about 6 μm to about 9 μm and a width of about 135 μm.

The scored film is then preformed into a double-gusset container as shown in FIG. 1. In an example, the double-gusset container has dimensions of about 7 inches wide by 11.5 inches long, and 2×2 inches width. The double-gusset container may be filled with 24 ounces of mixed vegetables and sealed using a heat sealer from TEW Electric Heating Equipment Co. Ltd., Taiwan. The filled double-gusset container may then be stored in a freezer at a freezing temperature of about −5 degrees F. The frozen double-gusset container was then heated for about 12 minutes of cook time at about 1,200 watts of microwave power. This sample was stored in the freezer at −5° F. and afterwards was tested in the MWS microwave testing station for 12 minutes of cook time at about 1,200 watts of power. As shown in FIG. 9, one pressure probe and three temperature probes were placed in the interior region to measure temperature and pressure before, during, and after the cook cycle.

The maximum pressure measured by the pressure probe was about 0.58 psi and the maximum temperature reached was about 226.7 degrees F. The package ballooned and the venting system opened during microwave cooking to cause the food products in the interior region to cook uniformly. The easy-open laser score did not open during or after the microwave cook cycle due to steam pressure, but instead was torn open by hand. The opened package is then arranged as a bowl such that users can consume the food products directly from the container.

The invention claimed is:

1. A package comprising a container including a sleeve including a top wall, an opposite bottom wall spaced apart from the top wall, a first side wall interconnecting the top and bottom walls, and a second side wall spaced apart from the first side wall and arranged to interconnect the top and bottom walls, a first end closure interconnecting the first and second side walls and the top and bottom walls along a first end of the sleeve, and a second end closure interconnecting the first and second side walls and the top and bottom walls along a second end of the sleeve and an opening system formed in the first side wall of the sleeve and configured to provide a mouth opening into an interior region formed in the container to cause products stored in the interior region to be accessible by a user in response to application of a first separation force applied to the top wall along the first side wall and a second separation force applied to the top wall opposite the first separation force along the first side wall after heating of the package has completed without causing a passageway to be formed in the container before heating or during heating so that steam and pressure are generated in a controlled manner during heating wherein the opening system comprises a heat-sealable sub-layer formed from at least one polypropylene/alpha-olefin copolymer and at least one polyethylene polymer resin.

2. The package of claim 1, wherein the container is made from a film including an outer protective layer and an inner layer and the opening system includes a trench formed in the outer protective layer and arranged to extend inwardly through the outer protective layer to the inner layer, wherein the inner layer includes the heat-sealable sub-layer.

3. The package of claim 2, wherein the trench is defined by a first trench wall, a second trench wall spaced apart from the first trench wall, and a trench floor provided by the inner layer.

4. The package of claim 3, wherein the trench is arranged to extend between the first and second end closures.

5. A package comprising a container including a sleeve including a top wall, an opposite bottom wall spaced apart from the top wall, a first side wall interconnecting the top and bottom walls, and a second side wall spaced apart from the first side wall and arranged to interconnect the top and bottom walls, a first end closure interconnecting the first and second side walls and the top and bottom walls along a first end of the sleeve, and a second end closure interconnecting the first and second side walls and the top and bottom walls along a second end of the sleeve and an opening system formed in the first side wall of the sleeve and configured to provide a mouth opening into an interior region formed in the container to cause products stored in the interior region to be accessible by a user in response to application of a first separation force applied to the top wall along the first side wall and a second separation force applied to the top wall opposite the first separation force along the first side wall after heating of the package has completed without causing a passageway to be formed in the container before heating or during heating so that steam and pressure are generated in a controlled manner during heating, wherein the container is made from a film including an outer protective layer and an inner layer and the opening system includes a trench formed in the outer protective layer and arranged to extend inwardly through the outer protective layer to the inner layer, wherein the inner layer includes a heat-sealable sublayer formed from at least one polypropylene/alpha-olefin copolymer and at least one polyethylene polymer resin, wherein the trench is defined by a first trench wall, a second trench wall spaced apart from the first trench wall, and a trench floor provided by the inner layer, wherein the trench is arranged to extend between the first and second end closures, wherein a depth of the trench is defined between the outer protective layer and the inner layer and the depth is about 6 μm to about 9 μm.

6. The package of claim 4, wherein a width of the trench is defined to between the first and second trench walls and the width is about 135 μm.

7. The package of claim 2, wherein the outer protective layer includes an outer surface arranged to face away from the inner layer and an inner surface arranged to face opposite the outer surface toward the interior region and the inner layer includes an outer surface arranged to face toward the outer protective layer and an inner surface arranged opposite the outer surface of the inner and define the interior region.

8. The package of claim 7, wherein the trench is defined by a first trench wall arranged to lie between the top and bottom walls and to extend between and interconnect outer and inner surfaces of the outer protective layer, a second trench wall arranged to lie in spaced apart relation to the first trench wall and located between the first trench wall and the bottom wall and arranged to extend between and interconnect outer and inner surfaces of the outer protective layer, and a trench floor provided by the outer surface of the inner layer and arranged to extend between and interconnect the first and second trench walls.

9. The package of claim 8, wherein the second side wall is arranged to face and lie in confronting relation with ground underlying and supporting the package, the top and bottom walls are arranged to extend in an upward direction away from ground when the package is oriented in an upright position, and the mouth opens in the upward direction so that products stored in the interior region are retained in the interior region by gravity when the package is oriented in the upright position.

10. The package of claim 1, wherein the container is made from a film including an outer protective layer and an inner layer including a sealant layer defining the interior region and an adhesive layer located between and arranged to interconnect the outer protective layer and the sealant layer and the opening system includes a trench formed in the outer protective layer and arranged to extend inwardly through the outer protective layer to the adhesive layer of the inner layer, wherein the sealant layer includes the heat-sealable sub-layer.

11. The package of claim 10, wherein the sealant layer includes an outer-skin sub-layer coupled to the adhesive layer of the inner layer and located between the adhesive layer and the interior region, the heat-sealable sub-layer defining the interior region, and a core sub-layer located between and interconnecting the heat-sealable sub-layer and the outer-skin sub-layer.

12. A package comprising a container including a sleeve including a top wall, an opposite bottom wall spaced apart from the top wall, a first side wall interconnecting the top and bottom walls, and a second side wall spaced apart from the first side wall and arranged to interconnect the top and bottom walls, a first end closure interconnecting the first and second side walls and the top and bottom walls along a first end of the sleeve, and a second end closure interconnecting the first and second side walls and the top and bottom walls along a second end of the sleeve and an opening system formed in the first side wall of the sleeve and configured to provide a mouth opening into an interior region formed in the container to cause products stored in the interior region to be accessible by a user in response to application of a first separation force applied to the top wall along the first side wall and a second separation force applied to the top wall opposite the first separation force along the first side wall after heating of the package has completed without causing a passageway to be formed in the container before heating or during heating so that steam and pressure are generated in a controlled manner during heating, wherein the container is made from a film including an outer protective layer and an inner layer including a sealant layer defining the interior region and an adhesive layer located between and arranged to interconnect the outer protective layer and the sealant layer and the opening system includes a trench formed in the outer protective layer and arranged to extend inwardly through the outer protective layer to the adhesive layer of the inner layer, wherein the sealant layer includes an outer-skin sub-layer coupled to the adhesive layer of the inner layer and located between the adhesive layer and the interior region, a heat-sealable sub-layer defining the interior region, and a core sub-layer located between and interconnecting the heat-sealable sub-layer and the outer-skin sub-layer, wherein the heat-sealable sub-layer is formed from at least one polypropylene/alpha-olefin copolymer, the polypropylene/alpha-olefin copolymer having a melt flow rate in a range of about 0.5 g/10 min. to about 45 g/10 min, and at least two different polyethylene polymer resins one of which has a melt index in a range of about 0.50 g/10 min. to about 20 g/10 min.

13. The package of claim 12, wherein the core sub-layer is formed from a polymeric material having a melting point of at least 71° C. and the outer-skin sub-layer is formed from at least one polyethylene polymer resin having a melt index in a range of about 0.50 g/10 min. to about 20 g/10 min.

14. The package of claim 10, wherein the outer protective layer is formed from a polymeric material that is temperature resistant at a temperature of about 105° C.

15. The package of claim 14, wherein the sealant layer does not fracture when exposed to a temperature in a range of about −20° C. to about 0° C.

16. The package of claim 1, wherein the first and second separation forces have a magnitude of about 250 lbf/in to about 500 lbf/in.

17. The package of claim 1, further comprising a steam-venting system configured to provide means for controlling pressure and temperature in the interior region during heating of the package to cause steam to be generated in the interior region and conducted through the container so that products stored in the interior region are heated uniformly throughout and the opening system remains closed throughout heating of the package.

18. The package of claim 17, wherein the steam-venting system is formed in the top wall of the package.

19. The package of claim 17, wherein the steam-venting system includes a series of spaced-apart slits arranged to provide a series of associated passageways providing communicating between the interior region and an environment surrounding the package.

20. The package of claim 19, wherein the series of spaced-apart slits includes first, second, and third columns of slits where each column of slits is spaced apart from each neighboring column of slits.

21. The package of claim 20, wherein at least one slit included in the series of spaced-apart slits has a length different from a length of the other slits included in the series of spaced-apart slits.

22. The package of claim 20, wherein the series of spaced-apart slits all have about the same length.

23. The package of claim 17, wherein the container is made from a film including an outer protective layer and an inner layer, the steam-venting system includes a series of spaced-apart slits arranged to extend from an outer surface of the outer protective layer towards an inner surface of the inner layer, and the inner surface of the inner layer defines the interior region, wherein the inner layer includes the heat-sealable sub-layer.

24. The package of claim 23, wherein the series of spaced-apart slits includes first, second, and third columns of slits where each column of slits is spaced apart from each neighboring column of slits.

25. The package of claim 1, wherein the top wall includes a first panel appended to the first side wall and arranged to extend toward the second side wall, a second panel appended to the second side wall and arranged to extend toward the first side wall, and a fin closure arranged to lie between and interconnect the first and second panels.

26. The package of claim 25, further comprising a steam-venting system configured to provide means for controlling pressure and temperature in the interior region during heating of the package to cause steam to be generated in the interior region and conducted through the container so that products stored in the interior region are heated uniformly throughout and the opening system remains closed throughout heating of the package.

27. The package of claim 26, wherein the steam-venting system is formed in the first panel of the top wall.

28. The package of claim 27, wherein the steam-venting system includes a series of spaced-apart slits arranged to provide a series of associated passageways providing communicating between the interior region and an environment surrounding the package.

29. The package of claim 25, further comprising a steam-venting system configured to provide means for maintaining a pressure of about 0.58 PSI and a temperature of about 226.7 degrees Fahrenheit in the interior region during heating of the package to cause steam to be generated in the interior region and conducted through the container so that products stored in the interior region are heated uniformly throughout, the opening system remains closed throughout heating of the package, and the package does not rupture in an unintended manner.

30. A package comprising a double-gusset container including a sleeve having a first end and a second end opposite the first end, a first end closure closing off the first end of the sleeve, and a second end closure closing off the opposite second end of the sleeve, the sleeve being formed from a cold-durable, heat-resistant, film including an outer protective layer configured to provide cold-temperature durability and an inner sealant layer laminated to the outer protective layer and an opening system formed in the outer protective layer of the cold-durable, heat-resistant film, arranged to extend between the first and second end closures, arranged to extend downwardly from an outer surface of the protective layer toward an inner surface of the outer protective layer that faces the inner sealant layer, and configured to allow the package to be heated without causing an opening to form in the double-gusset container until after heating of the package has been completed and a user applies separation forces to the container along the opening system to cause a mouth to be formed predictably that opens into an interior region formed in the container so that product located in the interior region may be removed from the interior region through the mouth wherein the inner sealant layer includes a heat-sealable sub-layer formed from at least one polypropylene/alpha-olefin copolymer and at least one polyethylene polymer resin.

31. The package of claim 30, wherein the opening system includes a trench formed in the outer protective layer and arranged to extend inwardly toward the interior region and terminate at a trench floor defined by the inner layer.

32. The package of claim 31, wherein the trench has a depth and a width configured to cause the inner layer to fracture along the trench in response to application of the separation forces so that the mouth is established predictably.

33. The package of claim 32, wherein the package further includes a steam-venting system configured to communicate steam generated in the interior region of the container during application of heat to the package through the container in a controller matter without causing the opening system to open without application of the separation forces.

34. The package of claim 30, wherein the outer protective layer is formed from a polymeric material that is temperature resistant at a temperature of about 105° C.

35. The package of claim 30, wherein the sealant layer does not fracture when exposed to a temperature in a range of about −20° C. to about 0° C.

36. The package of claim 1, wherein the separation forces have a magnitude of about 250 lbf/in to about 500 lbf/in.

* * * * *